US006824000B2

(12) United States Patent
Samelson

(10) Patent No.: US 6,824,000 B2
(45) **Date of Patent: *Nov. 30, 2004**

(54) TENSION ROD WITH SUCTION CUPS

(75) Inventor: David Samelson, Morristown, NJ (US)

(73) Assignee: Ex-Cell Home Fashions, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/653,605

(22) Filed: Sep. 3, 2003

(65) Prior Publication Data

US 2004/0040920 A1 Mar. 4, 2004

Related U.S. Application Data

(63) Continuation of application No. 10/106,164, filed on Mar. 27, 2002, now Pat. No. 6,651,831.

(51) Int. Cl.[7] ..... F16B 47/00; A47H 1/08

(52) U.S. Cl. ..... 211/105.3; 248/205.5; 248/309.3; 248/363

(58) Field of Search ..... 211/105.3, 105.1, 211/86.01, 175; 248/205.5, 363, 309.3, 683, 206.3, 467, 206.4, 200.1; 206/829; 40/597

(56) References Cited

U.S. PATENT DOCUMENTS

| | | | | |
|---|---|---|---|---|
| 3,639,919 | A | 2/1972 | White | |
| 3,934,636 | A | 1/1976 | Simmons | |
| 4,037,726 | A | 7/1977 | Schweers | |
| 4,824,302 | A | 4/1989 | Schultheis et al. | |
| 5,023,964 | A | 6/1991 | Unsworth | |
| 5,028,026 | A | 7/1991 | Philipps et al. | |
| 5,114,106 | A | 5/1992 | Daugherty | |
| 5,345,623 | A | 9/1994 | Dearman | |
| 5,561,870 | A | 10/1996 | Hertel | |
| 5,606,752 | A | 3/1997 | Shenton | |
| 5,649,780 | A | 7/1997 | Schall | |
| D397,928 | S | 9/1998 | Wise | |
| 5,809,589 | A | 9/1998 | Johnson | |
| D415,014 | S | 10/1999 | Bruton | |
| 6,016,926 | A | 1/2000 | Smith, II | |
| 6,032,306 | A | 3/2000 | Gummin | |
| 6,195,817 | B1 | 3/2001 | Chilton | |
| 6,216,287 | B1 | 4/2001 | Wise | |
| 6,651,831 | B2 * | 11/2003 | Samelson | 211/105.3 |

* cited by examiner

*Primary Examiner*—Carl D. Friedman
*Assistant Examiner*—Jennifer E. Novosad
(74) *Attorney, Agent, or Firm*—Epstein Drangel Bazerman & James, LLP

(57) ABSTRACT

A suction cup is mounted to each end of the tension rod by a mounting part. The mounting part has a body with a cylindrical recess to receive the rod end and a circular end part with a planar end surface with an opening. The enlarged hemispherical head portion of the suction cup is received in the opening such that the cup portion of the suction cup is proximate the end surface.

7 Claims, 2 Drawing Sheets

TENSION ROD WITH SUCTION CUPS

This is a continuation of application Ser. No. 10/106,164, filed Mar. 27, 2002, entitled:"Tension Rod With Suction Cups", now U.S. Pat. No. 6,651,831.

The present invention relates to tension rods for mounting shower curtains or the like and more particularly to means for mounting suction cups at each end of a tension road to enhance the engagement between the rod and the surface to which it is mounted, thereby increasing the amount of weight which the rod can hold.

Tension rods for mounting shower curtains and window curtains are well known in the art. They are wisely used because they are easy to install. No mounting hardware or special skill is required for the installation. They are also adjustable to accommodate a wide range of different size installation sites.

A typical tension rod consists of two hollow tubular sections, one of which is slightly smaller in diameter than the other such that it can be telescopically received within the other section. The sections can be moved relative to each other to alter the length of the rod, and then locked in position by rotating one section relative to the other, when the desired length is obtained.

In order to increase the frictional engagement between the rod and shower enclosure surface or window opening surface, a rubber tip is often used at either end of the rod. The rubber tip also reduces the possibility that the end of the rod will mar the surface which it engages.

Rods used to mount shower curtains are often situated between tiled surfaces in shower or bathtub enclosures. Because such surfaces are usually smooth, suction cups have been mounted on the ends of the rod to enhance the engagement between the rod and the tile surfaces to which the rod is mounted. The result is to increase the weight which the rod can carry, an important feature because the weight of a shower curtain greatly increases when it becomes wet. See, for, example, U.S. Pat. No. 4,037,726 to Schweers.

The present invention relates to a novel means for mounting a suction cup to the end of a tension rod which makes the product inexpensive to fabricate and easy to assemble. At the same time, it provides a strong base for the suction cup which permits the rod to support heavier loads.

It is, therefore, a prime object to provide a tension rod with suction cups which are mounted on the rod ends in a novel manner.

It is another object of the present invention to provide a tension road with suction cups which are mounted to the rod by mounting means which provides a strong base for the suction cups permitting the rod to support a heavier load.

In accordance with the present invention, a tension rod for mounting a shower curtain or the like is provided. The rod includes first and second tubular sections movable relative to each other to adjust the length of the rod. Each section has an end. Means are adapted to be received on each of the section ends for mounting a suction cup. The suction cup mounting means includes a body having a generally cylindrical recess for receiving the rod section and an end part having a generally planar exterior end surface with an opening. A suction cup for each end is provided including a cup portion, a head portion and a neck connecting the head portion and the cup portion. The head portion is larger than the opening. The head portion is received through the opening such that the cup portion is proximate the end surface.

The suction cup neck is approximately the same size as the end surface opening. The end surface opening is preferably round. The suction cup neck is preferably generally cylindrical.

The head portion includes an arcuate surface. The arcuate surface facilitates insertion of the head through the opening.

The mounting means body includes an exterior surface. The exterior surface has a circumferential recess.

Preferably, the end part is larger than the remainder of the body of the mounting means. The end part is generally circular. The end surface is also generally circular.

To these and such other objects which may hereinafter appear, the present invention relates to a tension rod with suction cups, as set forth in detail in the following specification and recited in the annexed claims, taken together with the accompanying drawings, wherein like numerals refer to like parts, and in which:

Figure 1:
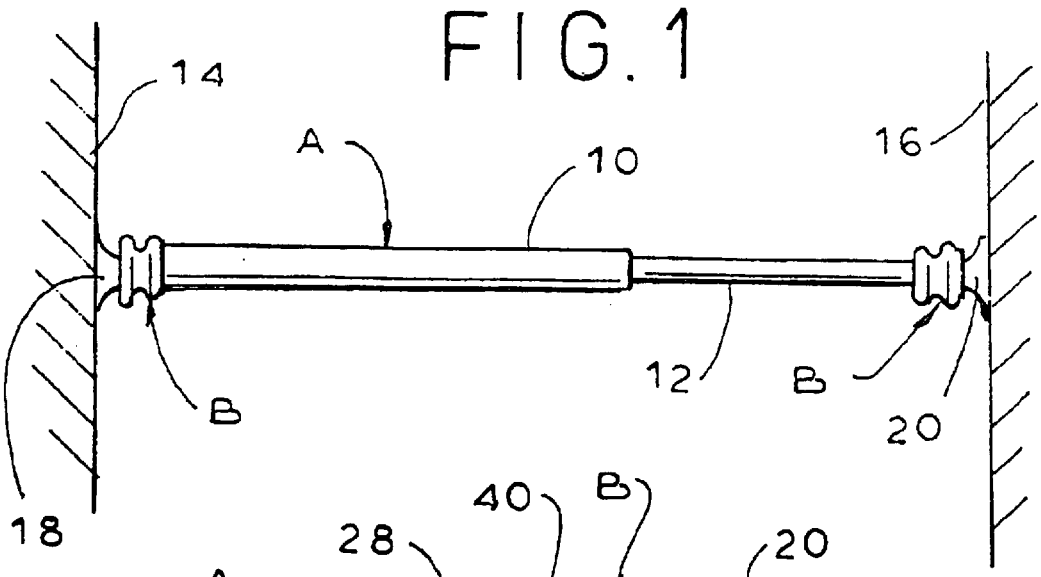
FIG. 1 is a side elevational view of a mounted tension rod with a first preferred embodiment of the suction cup mounting means of the present invention at each end.

As seen in FIG. 1, the tension rod, generally designated A, includes first and second hollow tubular sections 10 and 12. Section 12 has an outer diameter which is slightly smaller than the inner diameter of section 10 such that it is telescopically received within section 10. The tension rod is mounted between vertical surfaces 14, 16 which may be the tiled walls of a shower or bathtub enclosure.

The length of the rod is adjusted by rotating one section relative to the other. The sections are moved apart until the suction cups 18, 20, mounted to the ends of the rod sections, engage surfaces 14, 16, respectively. The rod sections then rotated relative to each other to lock the sections against further movement.

Suction cups 18, 20 are made of resilient material, such as rubber. Each includes a cup portion 22 and an enlarged hemisphere head portion 24 having an arcuate exterior surface. Head portion 24 is connected to the rear of cup portion 22 by neck 26. Neck 26 is cylindrical in shape and has a substantially smaller diameter than head portion 24. Preferably, all of the parts of the suction cups are integral, being formed together by molding or the like.

Figure 2:
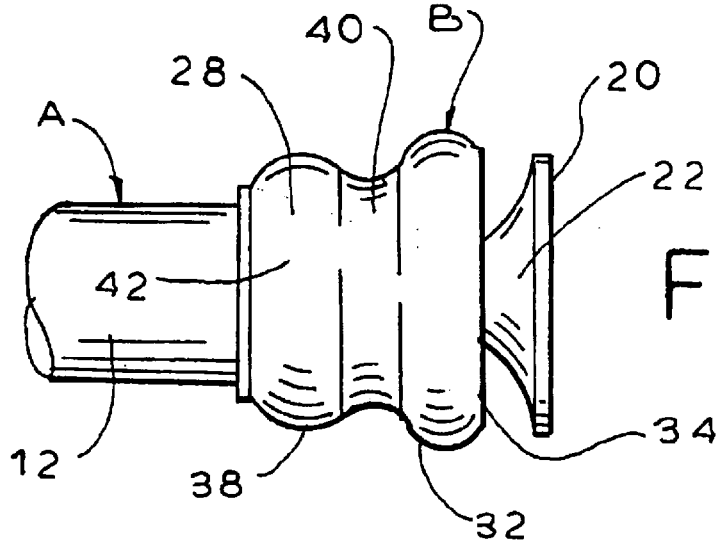
FIG. 2 is a side elevational view of the first preferred embodiment of the suction cup mounting means.
Figure 3:
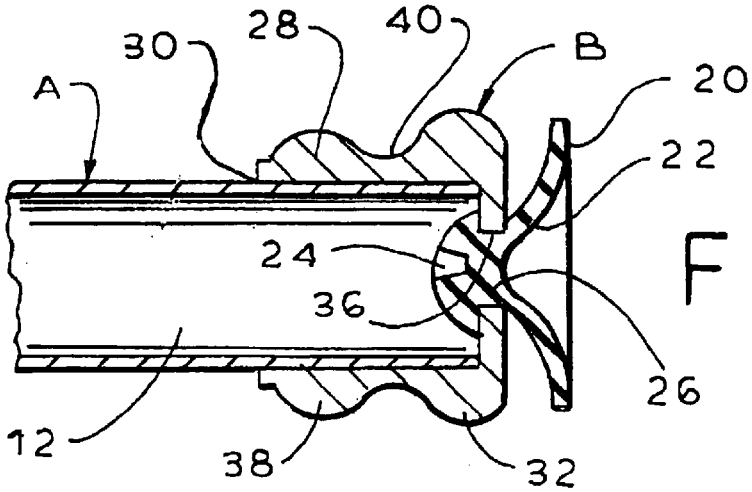
FIG. 3 is a side cross-sectional view of the suction cup mounting means of FIG. 2.

As seen in FIGS. 1, 2 and 3, the first preferred embodiment of the mounting means, generally designated B, has a generally cylindrical body 28 with an internal recess 30. The end of the tension rod section is received in and frictionally engaged within recess 30. The circular end part 32 of body 28 has a radius which is larger than the radius of the remainder of body 28 and has a generally planar end surface 34 which is also circular.

End part 32 has a circular central opening 36 with a diameter which is slightly larger than the diameter of the neck 26 of the suction cup. However, the diameter of neck 26 is substantially smaller than the diameter of head portion 24.

Because head portion 24 is composed of compressible material and because of its arcuate shape, it can be forced through opening 36 such that the portion of the end surface 34 surrounding opening 36 will lodge under the head portion, with neck 26 extending through opening 36. In this way, the suction cup is permanently fixed to the mounting means body in a strong manner, with surface 34 of end part 32 acting as a base for the suction cup.

The exterior side surface 38 of body 28 of the mounting means includes a circumferential recess 40 which extends around the body giving the exterior surface an aesthetically pleasing, wavy appearance. Recess 40 divides the exterior surface 38 into end part 32 and a section 42. The diameter of end part 32 is preferably slightly larger than the diameter of section 42.

Figure 4:
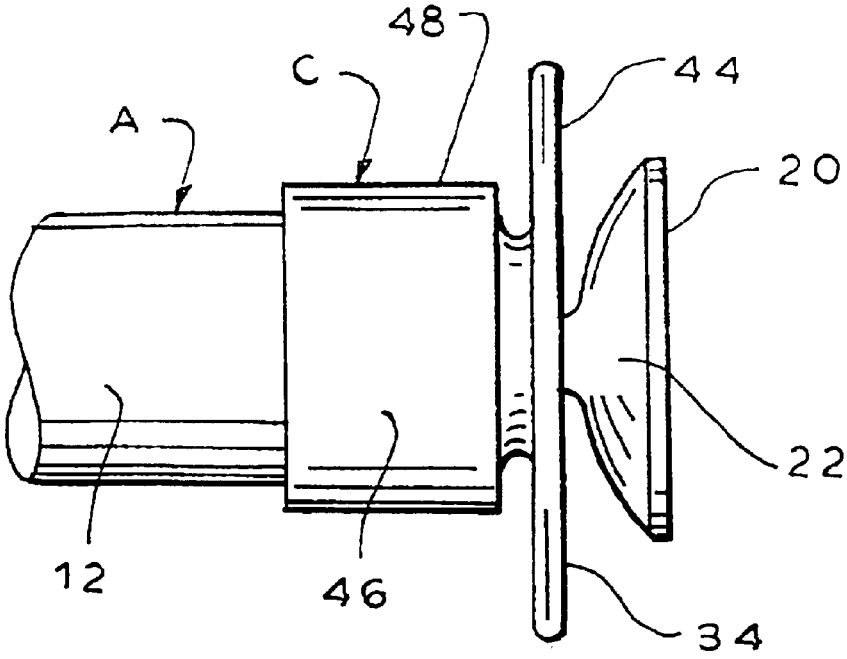
FIG. 4 is a side elevational view of a second preferred embodiment of the suction cup mounting means.
Figure 5:
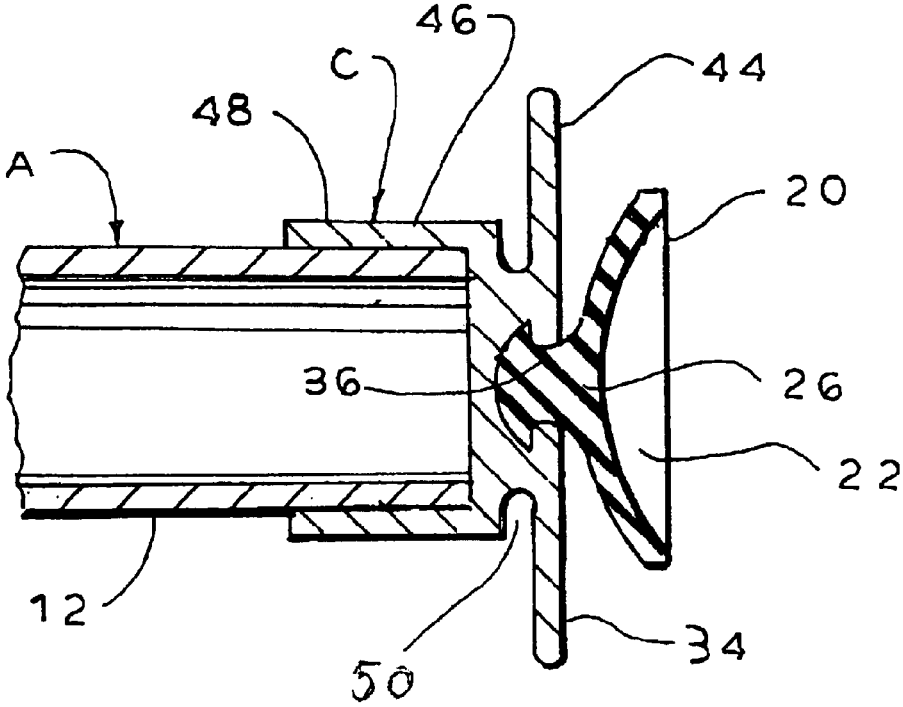
FIG. 5 is a side cross-sectional view of the mounting means of FIG. 4.

As seen in FIGS. 4 and 5, the second preferred embodiment of the mounting means, generally designated C, is similar to the first preferred embodiment except that the end part 44 of the body is thinner, and has a large diameter, as compared to end part 32 in the first preferred embodiment. Further, the body 46 of the mounting means has an exterior side surface 48 which is generally cylindrical in shape. The circumferential recess 50 has a smaller diameter than recess 40 in the first preferred embodiment. Further, in this embodiment, recess 50 is situated at a location on body 46 beyond the tension rod end.

It will now be appreciated that the present invention relates to a means for mounting suction cups to the ends of a tension rod. The mounting means has a body with a recess for receiving the rod end. It also has a generally circular end part with a generally planar end surface. The end surface has a central opening adapted to receive and retain the hemispherical head portion of the suction cup. The end part functions as a base for the suction cup.

While only a limited number of preferred embodiments of the present invention have been disclosed for purposes of illustration, it is obvious that many modifications and variations could be made thereto. It is intended to cover all of these modifications and variations which fall within the scope of the present invention, as defined by the following claims:

What is claimed is:

1. A tension rod for mounting a shower curtain to a surface comprising first and second tubular sections having an axis, said sections being moveable relative to each other to adjust the length of the rod, each of said sections having an end, means adapted to be received on each of said ends for mounting a suction cup, substantially perpendicular to said axis, said suction cup mounting means comprising a body having a generally cylindrical recess for receiving the rod section end and a generally circular end part, said end part having a generally planar end surface with an opening substantially aligned with said axis, and a suction cup comprising a cup portion, a head portion and a neck connecting said head portion and said cup portion, said head portion being larger than said opening in said end surface, said head portion being received through said opening in said end surface such that said cup portion is proximate to and supported by said end surface.

2. The rod of claim 1 wherein said end surface is generally circular.

3. The rod of claim 1 wherein said suction cup neck is approximately the same size as said end surface opening.

4. The rod of claim 1 wherein said end surface opening is round and said cup neck is generally cylindrical.

5. The rod of claim 1 wherein said head portion comprises an arcuate surface.

6. The rod of claim 1 wherein said body comprises an exterior surface, said exterior surface comprising a circumferential recess.

7. The rod of claim 1 wherein said body is generally cylindrical and said end part of said body has a diameter which is larger than a diameter of the remainder of said body.

* * * * *